US006360672B1

(12) United States Patent
Detar

(10) Patent No.: US 6,360,672 B1
(45) Date of Patent: Mar. 26, 2002

(54) LOCOMOTIVE WITH OPERATOR CABIN REAR IMPACT PROTECTION

(75) Inventor: Gail Leroy Detar, Erie, PA (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/689,966

(22) Filed: Oct. 12, 2000

(51) Int. Cl.[7] ..... B61C 17/00
(52) U.S. Cl. ..... 105/26.05; 105/238.1
(58) Field of Search ..... 105/456, 26.05, 105/238.1, 342, 340, 459; 296/190.03, 95.1; 280/748

(56) References Cited

U.S. PATENT DOCUMENTS

| | | | | |
|---|---|---|---|---|
| 3,450,430 A | * | 6/1969 | Wendt et al. | 296/28 |
| 3,451,713 A | * | 6/1969 | Hollingshead | 296/28 |
| 3,841,430 A | * | 10/1974 | Babbitt et al. | 180/89 A |
| 3,875,869 A | | 4/1975 | Molner | |
| 3,973,796 A | * | 8/1976 | Suzuki | 296/28 C |
| 4,050,735 A | * | 9/1977 | Molnar | 296/102 |
| 4,079,985 A | * | 3/1978 | Martin | 296/28 |
| 4,082,343 A | * | 4/1978 | Hurt et al. | 296/28 C |
| 4,184,434 A | | 1/1980 | Chapin | |
| 4,186,665 A | * | 2/1980 | de Jong et al. | 105/456 |
| 4,715,292 A | | 12/1987 | Pavlick et al. | |
| 5,203,601 A | * | 4/1993 | Guillot | 296/77.1 |
| 5,355,806 A | * | 10/1994 | Bieber et al. | 105/26.05 |
| 5,537,933 A | * | 7/1996 | Ablad | 105/457 |
| 5,577,449 A | * | 11/1996 | Kleiner et al. | 105/26.05 |

FOREIGN PATENT DOCUMENTS

JP 08151665 A * 5/1996

OTHER PUBLICATIONS

Code of Federal Regulations, Title 49, vol. 4, Parts 200 to 399, Revised as of Oct. 1, 1999 Cites: 49CRF238.117, 49CFR238.1, 49CRF238.209, 49CFR238.409.
Code of Federal Regulations, Title 49, vol. 4, Parts 200 to 399, Revised as of Oct. 1, 1999 Cite: 49CFR238.1
Code of Federal Regulations, Title 49, vol. 4, Parts 200 to 399, Revised as of Oct. 1, 1999 Cite: 49CRF238.209.
Code of Federal Regulations, Title 49, vol. 4, Parts 200 to 399, Revised as of Oct. 1, 1999 Cite: 49CFR238.409.

* cited by examiner

*Primary Examiner*—S. Joseph Morano
*Assistant Examiner*—Frantz F. Jules
(74) *Attorney, Agent, or Firm*—Carl A. Rowold, Esq.

(57) ABSTRACT

A protective member positioned at the rear of the operator cab of a locomotive. The protective member provides impact protection for a passenger in the locomotive in the event of an impact between the rear panel of the locomotive and a foreign object during long hood lead (reverse) operation. The protective member may include a vertical member disposed under the outer sheet material at a rear corner of the operator cab as well as members surrounding the rear window opening. The protective member may be formed of rectangular steel tubing and is anchored directly or indirectly to the platform of the locomotive.

8 Claims, 2 Drawing Sheets

LOCOMOTIVE WITH OPERATOR CABIN REAR IMPACT PROTECTION

BACKGROUND OF THE INVENTION

The present invention relates generally to railroad locomotives and more particularly to the operator cab structure of a locomotive.

It is well known that railroads are an economical and energy efficient form of transportation, particularly for hauling extremely heavy or bulky freight over long distances. A train may typically include a string of interconnected rail cars carrying freight or passengers propelled by one or more locomotives connected at the front and/or rear of the string of cars, and often a caboose connected at the end of the train. A train engineer and others ride in an operator cab portion of the locomotive to control the operation of the train.

A typical locomotive includes a platform supporting a power plant equipment compartment housing an engine and electrical generator, an auxiliary equipment compartment housing electrical control systems, and an operator cab. The platform is supported on a plurality of multi-axle trucks containing electric motors for propelling the locomotive along the rails. The operator cab is normally positioned at the front of the locomotive to afford the engineer the best possible view of the oncoming rails. The operator cab has an outer sheet material defining the shape of the cab including opposed sides which extend beyond the sides of the adjacent equipment compartments of the locomotive, thereby defining an operator cab rear panel. Window openings formed in the outer sheet material afford the engineer and others in the operator cab views toward the front, sides and rear of the locomotive.

There is an increasing interest in improving the safety of the passengers of trains, especially the occupants of the locomotive. The leading position of the operator cab exposes the engineer and others in the operator cab to danger when the locomotive strikes any object in its path. As early as 1989 the American Association of Railroads published specifications for the structural hardening of the front wall of locomotives to improve the protection afforded to its occupants. Title 49 of the Code of Federal Regulations includes the current Federal Railroad Administration requirements for passenger equipment safety, including specific strength requirements for the forward end structures of power car cabs (see Section 238.409).

All current regulations for locomotive cab safety are directed at mitigating the result of a forward direction collision, i.e. the short hood lead direction of travel. However, it is possible to operate a locomotive in a reverse direction with the long hood (equipment compartments) leading. It is expected that occupants of the locomotive are much safer during this mode of operation because the structure and weight of the power plant equipment and auxiliary equipment compartments are travelling forward of the operator cabin, thereby providing a significant buffer and reducing the amount of energy that must be absorbed by the operator compartment.

However, the inventors have realized that existing regulations do not address the protection of locomotive passengers against the penetration of the operator cab by objects that may strike the operator cab rear panel during long hood lead operation of the locomotive. Such objects may include, for example, a section of wood cribbing extending from a passing train on an adjacent track. Such objects may pass untouched by the power plant and auxiliary equipment compartments of the locomotive and collide directly into the operator cab rear panel, thereby penetrating either the rear window or the outer sheet material.

BRIEF SUMMARY OF THE INVENTION

Thus there is a particular need for improved protection for the passengers of a locomotive against collisions from a rearward direction, and in particular, from collisions with objects that may pass untouched by the equipment compartments to strike directly into the operator cab rear panel.

Accordingly, a rail vehicle is described as including a platform; trucks connected to the platform for supporting and propelling the platform on rails; an equipment compartment attached to the platform and having opposed sides; an operator cab attached to the platform proximate the equipment compartment and having opposed sides, the sides of the operator cab extending beyond the sides of the equipment compartment to define an operator cab rear panel on each of opposed sides of the rail vehicle; each operator cab rear panel further comprising a protective member connected to the platform and adapted to withstand a predetermined impact load imposed by an object moving along the respective side of the power unit compartment toward the operator cab rear panel. In order to optimize the aesthetic appeal of such a design, the protective member may be disposed inside the outer sheet material at a rear corner of the operator cab To optimize the load carrying capability of such a protective member, a vertical member disposed at a rear corner of the operator cab may be connected with a horizontal member extending along the side of the operator cab, and with a cross member connected between the vertical and horizontal members around a side window of the operator cab.

BRIEF DESCRIPTION OF THE DRAWINGS

The features and advantages of the present invention will become apparent from the following detailed description of the invention when read with the accompanying drawings in which.

DETAILED DESCRIPTION OF THE INVENTION

Figure 1:
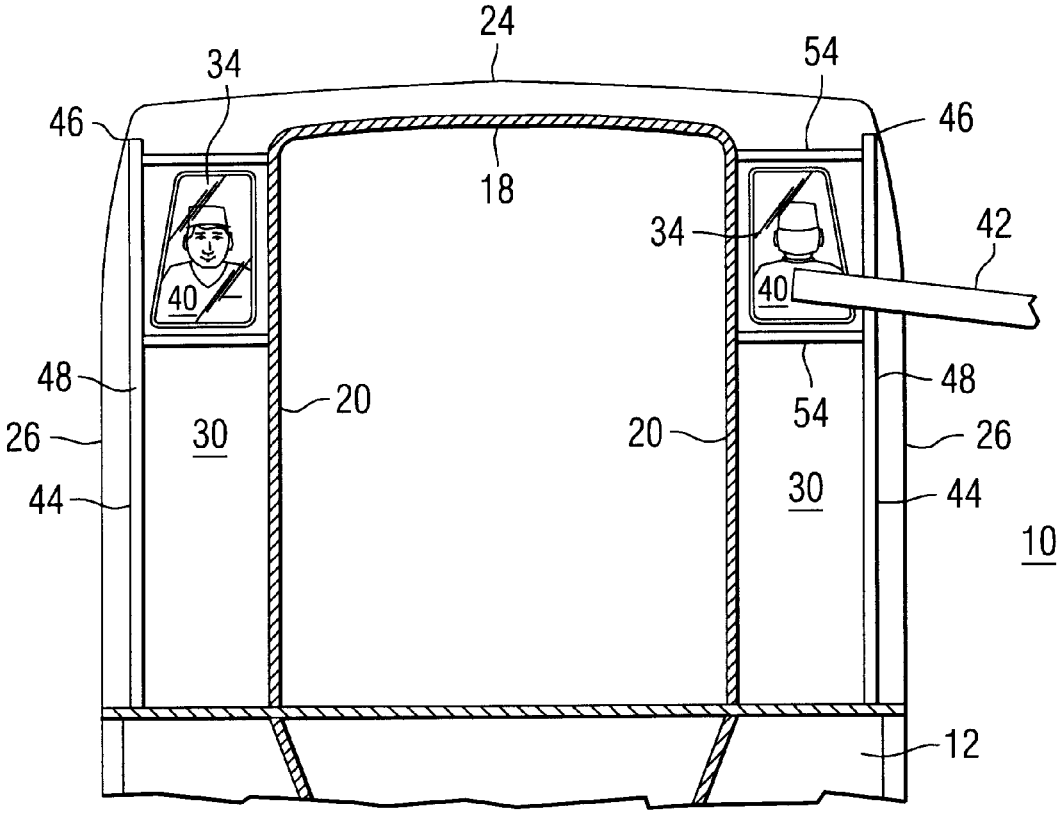
FIG. 1 is a partial rear view of a locomotive having an operator cab rear panel protective member.
Figure 2:
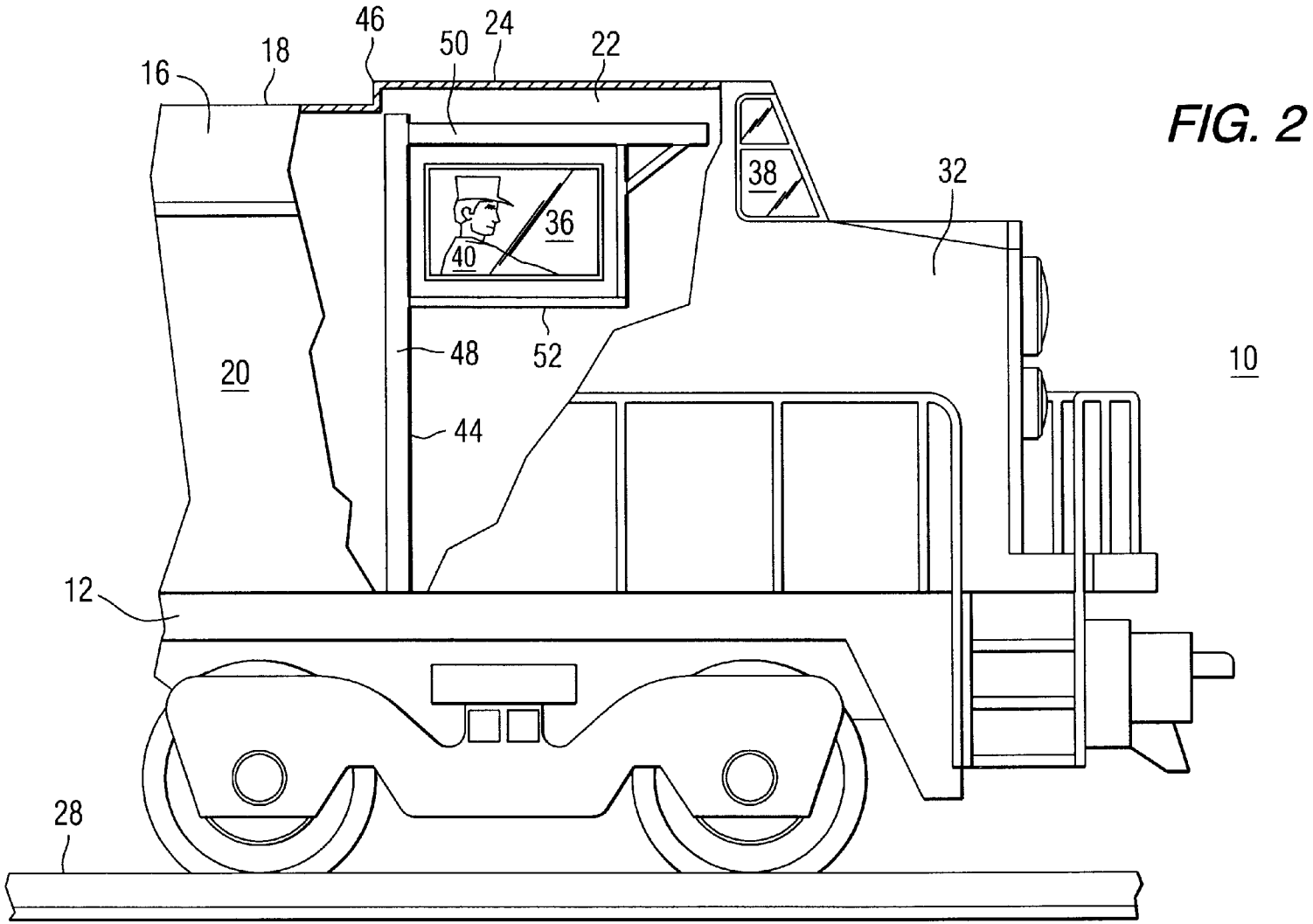
FIG. 2 is a partial side view of the locomotive of FIG. 1.

FIG. 1 is a partial rear sectional view of a locomotive 10. FIG. 2 is a side elevation view of the same locomotive. The following description may be best understood while referring to both figures together. The locomotive 10 includes a platform 12 supported by a multi-axle truck 14. An equipment compartment 16 having a roof 18 and opposed sides 20 is supported on the platform 12 directly behind an operator cab 22. The operator cab 22 includes a roof 24 and opposed sides 26. The sides 26 of the operator cab 22 extend beyond the sides of the equipment compartment 16 in a direction perpendicular to the direction of the tracks 28, thereby exposing an operator cab rear panel 30 on each side of the locomotive 10. The operator cab 24 includes an outer sheet material 32 defining the external shape of the cab, and a plurality of openings in the outer sheet material 32 for windows, including rear windows 34, side windows 36, and front windows 38. An engineer and other persons 40 operating the locomotive 10 occupy positions within the operator cab 24 near the various windows, 34,36,38.

As is illustrated in FIG. 1, a foreign object such as 4"×4" wooden cribbing material 42, may extend into the axial envelope defined by the locomotive to an extent necessary to collide with the operator cab rear panel 30 but not with the equipment compartment 16 when the locomotive is operated in a reverse direction with the long hood of the equipment compartment 18 leading. A prior art locomotive in this position would expose the operator to a dangerous condition, as the foreign object may shatter the rear window, penetrate the operator compartment, and/or cause damage to equipment and injury to people within the operator cab 24. The locomotive 10 described herein is protected from such a hazard by a protective member 44 disposed on each side of the locomotive at respective rear corners 46 of the operator cab 24. Protective member 44 is designed to withstand a predetermined impact load without failing, thereby deflecting and preventing any foreign object 42 from entering the interior of the operator cab 24. The predetermined load may be selected as a function of the design speed of operation of the locomotive 10 and the anticipated type of foreign object. In one embodiment, protective member 44 may be designed to withstand an impact load of at least 45,000 pounds anywhere along its length without exceeding its ultimate strength.

Protective member 44 may take a variety of shapes. The embodiment illustrated in the figures includes a generally vertical member 48 attached directly or indirectly at a bottom end to the platform 12 and extending upward along the fill length of the rear corner 46 of the operator cab 24. The generally vertical member 48 is also attached to a generally horizontal member 50 at a top end. The generally horizontal member 50 extends along a side 26 of the operator cab 24 and is attached to a third member 52 also extending along the side 26 of the operator cab 24. Third member 52 is formed to fit around window opening 36. Protective structure may further include member 54 extending proximate rear window opening 34. When the locomotive 10 strikes foreign object 42, a force will be imposed on the vertical member 48. That force will be partially absorbed by elastic deformation of member 48 and localized plastic deformation of that member, and will be partially transferred to members 50,52,54 as well as to various fasteners (not shown) joining protective member 44 to the platform 12, operator cab structure, and equipment compartment structure. Foreign object 42 will be repelled away from the interior of the operator cab 24 by this force, thereby protecting occupant 40 and equipment located inside the operator cab 24. A single generally vertical member 48 may provide adequate protection, however, window framing members 54 provide an additional barrier against penetration by foreign object 42 into the interior of the operator cab 24. Members 50,52 are provided for the purpose of transferring and absorbing force and not as protection against a side impact, although they will provide some such protection.

Protective member 44 may be formed of any material known to be sufficiently strong to withstand the required design loads, such as steel, aluminum, fiber reinforced plastic, etc. The various members 48,50,52,54 forming protective member 44 may be selected to be one or several shapes depending upon the constraints of the particular application, for example, solid bar, round tubing, rectangular tubing, channel, I-beam, etc. The various members may be joined together and/or to other parts of the locomotive 10 with known fastening techniques and hardware, for example, welding or bolting. Protective member 44 may be designed to fit entirely within the outer sheet material 32 so as to be entirely hidden from view, or it may be designed to include a visible exterior component as part of an overall aesthetically pleasing body design.

While the preferred embodiments of the present invention have been shown and described herein, it will be obvious that such embodiments are provided by way of example only. Numerous variations, changes and substitutions will occur to those of skill in the art without departing from the invention herein. Accordingly, it is intended that the invention be limited only by the spirit and scope of the appended claims.

I claim:

1. A locomotive comprising:

a platform having a forward end and a rearward end;

a truck connected to the platform for supporting and propelling the platform on rails;

an equipment compartment attached to the platform and having opposed sides;

an operator cab attached to the platform forward of the equipment compartment and having opposed sides, at least one side of the operator cab extending beyond one of the sides of the equipment compartment to expose an operator cab rear panel, the operator cab rear panel defining a rearwardly-exposed portion of the operator cab which is not protected by the equipment compartment from impact with a foreign object when the locomotive is operated in a rearward direction; and a protective member disposed proximate the operator cab rear panel for providing impact protection for the rearwardly-exposed portion against a forward-directed load imparted by a foreign object striking the rearwardly-exposed portion of the operator cab, the protective member being substantially confined within the rearwardly-exposed portion and providing localized impact protection to only the rearwardly-exposed portion of the operator cab.

2. The locomotive of claim 1, wherein the protective member is oriented to have its greatest load bearing capability in a forward direction for providing the localized protection against the forward-directed load, and wherein the protective member further comprises:

a generally vertical member attached to the platform and extending upward along a rear corner of the rearwardly-exposed portion of the operator cab;

a generally horizontal member connected to a top end of the generally vertical member; and a third member connected between the generally vertical member and the generally horizontal member to increase the load bearing capability of the generally vertical member in the forward direction for absorbing and distributing the forward-directed load applied by the foreign object.

3. The locomotive of claim 2, wherein the third member is formed to fit around a window opening in the at least one side of the operator cab.

4. The locomotive of claim 1, wherein the protective member further comprises a generally vertical member having a solid cross-section attached to the platform and extending upward within a rear corner of the rearwardly-exposed portion of the operator cab.

5. An operator cab of a locomotive, the operator cab comprising:

a first portion which is protected from rearward impact by an equipment compartment of the locomotive;

a rearwardly-exposed portion which is not protected from rearward impact by the equipment compartment;

a protective member disposed proximate only the rearwardly-exposed portion and providing localized protection for only the rearwardly-exposed portion against a forward-directed load imparted by a foreign object striking the rearwardly-exposed portion when the locomotive is operated in a rearward direction;

wherein the protective member further comprises:

a generally vertical member extending upward along a rear corner of the rearwardly-exposed portion;

a generally horizontal member connected to a top end of the generally vertical member; and a third member connected between the generally vertical member and the generally horizontal member to increase the load bearing capability of the generally vertical member in the forward direction for absorbing and distributing the forward-directed load applied by the foreign object.

6. The operator cab of claim 5, wherein the third member bounds a window opening.

7. A locomotive comprising:

a platform having a forward end and a rearward end;

a truck connected to the platform for supporting and propelling the platform on rails;

an equipment compartment attached to the platform and having opposed sides;

an operator cab attached to the platform forward of the equipment compartment and having opposed sides, at least one side of the operator cab extending beyond one of the sides of the equipment compartment to expose an operator cab rear panel, the operator cab rear panel defining a rearwardly-exposed portion of the operator cab which is not protected by the equipment compartment from impact with a foreign object when the locomotive is operated in a rearward direction; and a protective member disposed proximate the operator cab rear panel for providing impact protection for the rearwardly-exposed portion against a forward-directed load imparted by a foreign object striking the rearwardly-exposed portion of the operator cab, the protective member being oriented to have its greatest load bearing capability in a forward direction for providing localized protection against the forward-directed load;

wherein the protective member further comprises:

a generally vertical member attached to the platform and extending upward along a rear corner of the rearwardly-exposed portion of the operator cab:

a generally horizontal member connected to a top end of the generally vertical member; and a third member connected between the generally vertical member and the generally horizontal member to increase the load bearing capability of the generally vertical member in the forward direction for absorbing and distributing the forward-directed load applied by the foreign object.

8. The locomotive of claim 7, wherein the third member is formed to fit around a window opening in the at least one side of the operator cab.

* * * * *